US006532925B1

(12) United States Patent
Moya

(10) Patent No.: US 6,532,925 B1
(45) Date of Patent: Mar. 18, 2003

(54) STAMPED VALVE SPRING AND RETAINER

(75) Inventor: Avelino Moya, Malone, WI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/095,247

(22) Filed: Mar. 11, 2002

(51) Int. Cl.[7] ..... F01L 3/10

(52) U.S. Cl. ..... 123/90.65; 123/90.66; 123/90.67; 123/188.17; 267/158; 251/337

(58) Field of Search ..... 123/90.65, 90.66, 123/90.67, 188.17; 267/158; 251/337

(56) References Cited

U.S. PATENT DOCUMENTS

| | | | | |
|---|---|---|---|---|
| 972,434 A | | 10/1910 | Blomberg | |
| 1,154,971 A | | 9/1915 | Canton et al. | 251/337 |
| 1,215,756 A | | 2/1917 | Wemp | |
| 2,217,549 A | | 10/1940 | Hemmingsen | 123/188.1 |
| 2,824,554 A | | 2/1958 | Sampietro | 123/28 |
| 3,097,633 A | | 7/1963 | Klein | 123/79 R |
| 3,358,659 A | | 12/1967 | Renger | 123/90.65 |
| 3,551,921 A | | 1/1971 | Fox et al. | 4/694 |
| 3,602,205 A | | 8/1971 | Turkish | 123/90.65 |
| 4,380,216 A | | 4/1983 | Kandler | 123/90.65 |
| 4,420,141 A | | 12/1983 | Goloff | 251/337 |
| 4,919,090 A | * | 4/1990 | Deuring et al. | 123/90.67 |
| 5,046,463 A | * | 9/1991 | Worsley | 123/90.67 |
| 5,293,848 A | * | 3/1994 | Rich et al. | 123/90.67 |
| 5,322,039 A | * | 6/1994 | Kinsey | 123/90.67 |
| 5,368,358 A | | 11/1994 | Christensen | 297/215 |
| 5,449,147 A | | 9/1995 | Pace et al. | 251/337 |
| 6,302,070 B1 | * | 10/2001 | Tsukui et al. | 123/90.16 |

FOREIGN PATENT DOCUMENTS

| | | | | |
|---|---|---|---|---|
| FR | 2609107 A1 | * | 12/1986 | F01L/1/02 |

* cited by examiner

*Primary Examiner*—Thomas Denion
*Assistant Examiner*—Ching Chang
(74) *Attorney, Agent, or Firm*—Baker & Daniels

(57) ABSTRACT

A bias element which urges the valves in an internal combustion engine into their closed positions and includes a pair of arms and a bight portion connecting the two arms. Each arm has an aperture therein with at least one arm having an aperture that is keyhole-shaped, or having a first portion and second portion that is larger than the first portion. The arm which has the keyhole-shaped aperture is in operative biasing engagement with the end portion of a valve stem and the keyhole-shaped aperture engages the valve stem in that the first portion of the aperture lockingly engages the neck portion of the valve stem. The other arm is engages the shank portion of the valve stem.

14 Claims, 4 Drawing Sheets

STAMPED VALVE SPRING AND RETAINER

BACKGROUND OF THE INVENTION

1. Field of Invention

The present invention relates to internal combustion engines, specifically springs for urging the intake and exhaust valves toward the closed position during operation of the engine.

2. Description of the Related Art

Use of springs to maintain internal combustion engine exhaust and intake valves in a closed position is known in the art. Springs which are used in existing engine combinations include coil springs, torsion bars, "hairpin" springs, and other such springs. However, such springs require an additional mechanism or retainer to keep the spring engaged with the exhaust and intake valves.

Previous methods of maintaining the spring engaged with the valve have included the use of additional flanges (U.S. Pat. No. 3,097,633) or the use of separate retainers (U.S. Pat. No. 972,434), as discussed above. These approaches require additional parts to be used with the valve spring, thereby increasing the cost and complexity of installation. When utilizing additional retainers for the spring, both the spring and retainer must be installed and connected rather than a single piece being installed.

What is needed is a valve spring which does not require additional elements or mechanisms such as retainers to maintain engagement with the exhaust and/or intake valves but which does provide ease of installation.

SUMMARY OF THE INVENTION

The present invention provides a bias element which urges the valves in an internal combustion engine toward their closed positions and includes a pair of arms and a bight portion connecting the two arms. Each arm has an aperture therein with at least one arm having an aperture that is keyhole-shaped, or having a first portion and second portion that is larger than the first portion. The arm which has the keyhole-shaped aperture is in operative biasing engagement with the head portion of a valve stem and the keyhole-shaped aperture engages the valve stem such that the first portion of the aperture is in locking engagement with the neck portion of the valve stem. The other arm engages the shank portion of the valve stem when the bias element is positioned on the head or block.

The bias element is a one-piece valve spring and retainer thereby overcoming the above described problems by reducing the number of parts machined or required and by eliminating the need for a separate spring retainer. Furthermore, by being only one piece, the spring and retainer may be installed easily in the engine without requiring that a spring be installed and then a separate retainer installed and attached to the spring.

In one form, the present invention provides a bias element for an internal combustion engine, which engine has an intake valve and an exhaust valve with each valve including a valve stem and having an open position and a closed position. Each valve stem has an end portion and a shank portion. The bias element urges the respective valve toward its closed position and includes a first arm, a second arm, and a bight portion therebetween. The first arm includes an aperture therein having a keyhole shape with a first portion and a second portion, in which the second portion is larger than the first portion. The first arm is in operative biasing engagement with the end portion of the valve stem with the first portion of the aperture being in locking engagement with the neck portion. The second arm has an aperture therein through which the shank portion of the valve stem extends.

The present invention further provides a method of assembling a valve spring and retainer to a valve or block wherein the spring and retainer have upper arm and a lower arm with each arm having an aperture therein, aligning the spring and retainer with a valve stem, sliding the valve stem through the apertures in both arms of the valve spring and retainer, and sliding the upper arm laterally to thereby lockingly engage the valve stem.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates an embodiment of the invention and such exemplification is not to be construed as limiting the scope of the invention in any manner.

DETAILED DESCRIPTION

Figure 1:
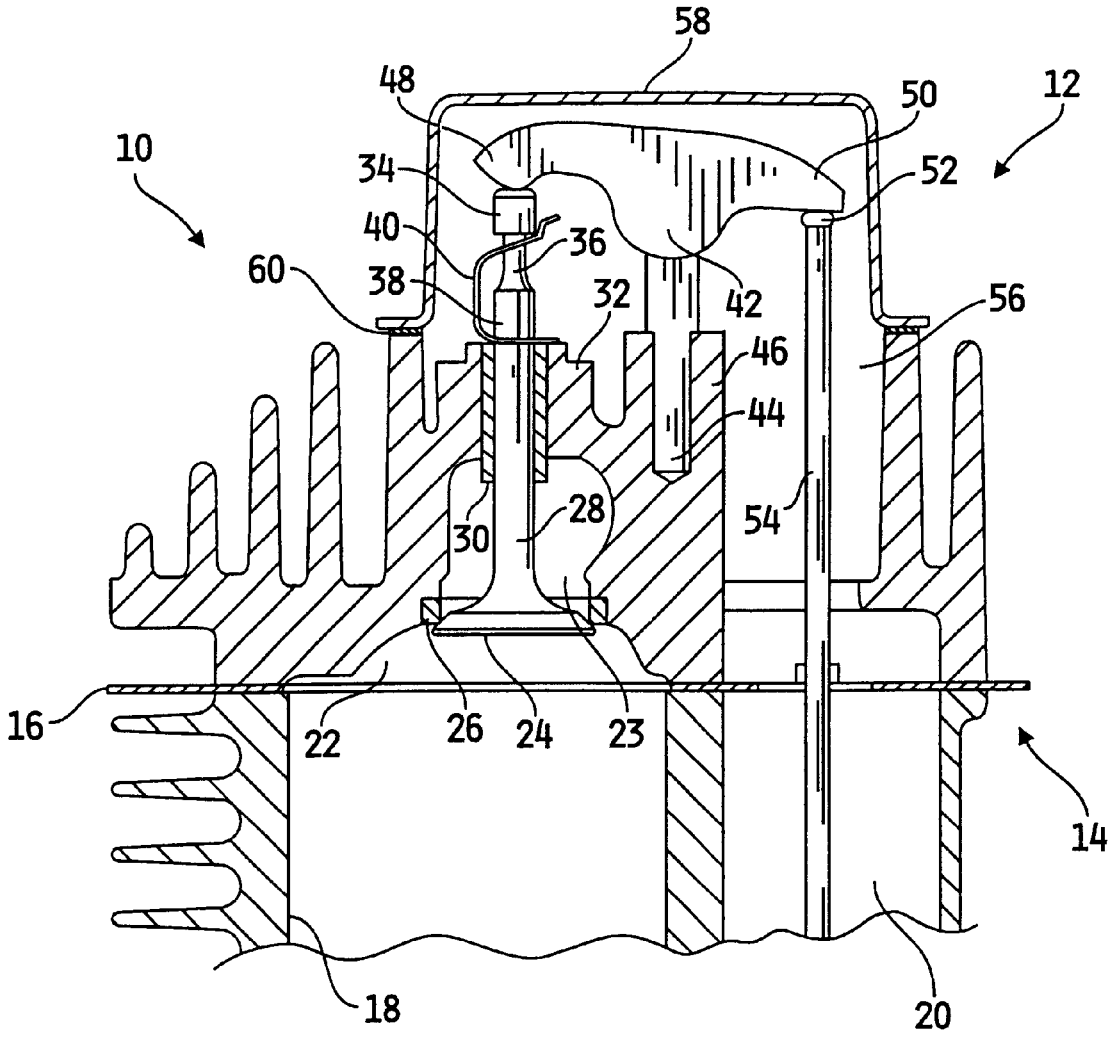
FIG. 1 is a sectional view of a portion of an internal combustion engine including a valve spring and retainer in accordance with one form of the present invention.

Referring first to FIG. 1, a portion of a vertical shaft or horizontal shaft internal combustion engine 10 is shown as including cylinder head 12 and cylinder 14, between which sealing gasket 16 is disposed. Internal combustion engine 10 is an air cooled overhead valve engine, such as that disclosed in U.S. Pat. No. 5,105,777, assigned to the assignee of the present invention, the disclosure of which is expressly incorporated herein by reference. Although the invention is shown mounted in an overhead valve engine, for purposes of illustration, the invention is not so limited and the valve and retainer could be utilized in side valve and overhead cam engines as well. Cylinder 14 includes cylinder bore 18 and push rod chamber 20. Within cylinder head 12 is combustion chamber 22 aligned with and in communication with cylinder bore 18 and intake chamber 23 through which valve stem 28 extends. Valve 24 is seated on seat 26 to provide selective communication between combustion chamber 22 and intake chamber 23. It is to be noted that the valve assembly of FIG. 1 is shown as an intake valve; however an exhaust valve assembly would be similar to this intake valve assembly.

Valve 24 includes valve stem 28 which is slidingly received in guide 30 fitted within boss 32 of cylinder head 12 and which includes end portion 34 and shank 38 including a reduced neck portion 36. Valve spring and retainer 40 is seated on boss 32 at one end and engages underside surface 64 of end portion 34 at the other end thereof. In such a position, spring 40 is disposed in compression between boss 32 and end portion 34 such that valve 24 is urged against valve seat 26.

Rocker arm 42 is pivotally mounted on rocker arm stud 44 located within rocker arm boss 46 of cylinder head 12. Rocker arm 42 includes first end 48 abutting the top of end portion 34 of valve stem 28. Second end 50 of rocker arm 42 is in engagement with push rod 54 at ball end 52 thereof. Further included within cylinder head 12 is rocker arm chamber 56 which is in alignment with push rod chamber 20 of cylinder 14 and through which push rod 54 extends. At the end of push rod 54 opposite ball end 52, push rod 54 engages a cam (not shown) on a cam shaft (not shown) for operation of rocker arm 42 to actuate valve 24. Covering rocker arm 42 and valve stem 28 is rocker arm cover 58 which is secured to cylinder head 12 by screws or bolts and is sealed by cover gasket 60.

With reference to FIGS. 2A, 2B, 2C, 2D, 2E, 2F, and 3, valve spring and retainer 40 is shown as having upper arm 66, lower arm 68 and bight portion 70 therebetween, and within each arm 66 and 68 is an aperture 72. It should be noted that the terms "upper" and "lower" with reference to arms 66 and 68 merely indicates the arrangement of the arms with respect to cylinder head 12 and boss 32. Valve spring and retainer 40 is made of stamped spring steel such as stainless steel 316 having a thickness of 0.040 inches. However, it should be noted that the invention is not limited to this particular type of material or thickness. Upper arm 66 forms an obtuse angle relative to bight portion 70 in the disclosed first bent configuration in FIGS. 2B and 2C and in the disclosed fourth configuration in FIG. 2F, with the angle between upper arm 66 and bight portion 70 of the fourth configuration being less than the angle of the first configuration. Alternatively, angle Φ, or the angle of upper arm 66 relative to a horizontal plane, is less in the fourth configuration than in the first. Each aperture is shown as having a keyhole shape with second portion 76 of the aperture being larger than first portion 74 to facilitate easy insertion of valve stem 28 through valve spring and retainer 40 when placing valve spring and retainer 40 in position, as described hereinbelow. In the second and third configurations of FIGS. 2D and 2E, upper arm 66 forms a substantially right angle with bight portion 70 rather than an obtuse angle.

Figure 2A:
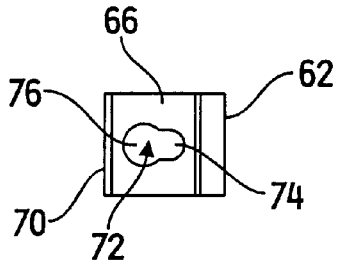
FIG. 2A is a top view of the valve spring and retainer of FIG. 1.
Figure 2B:
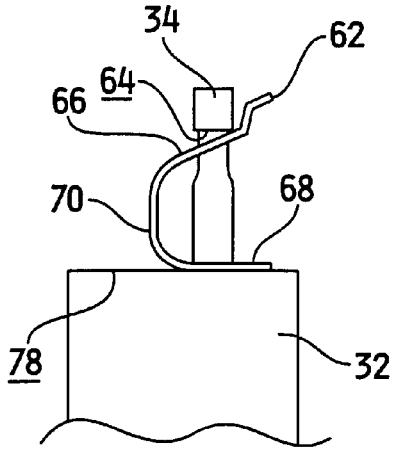
FIG. 2B is a side view of the valve spring and retainer of FIG. 1 mounted on the valve stem.
Figure 2C:
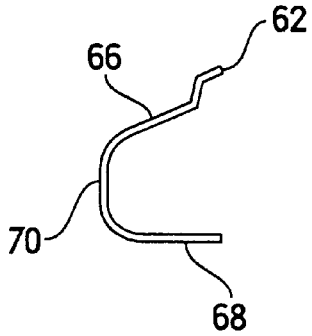
FIG. 2C is a side view of a first configuration of the valve spring and retainer of FIG. 2A in an unmounted position.
Figure 2D:
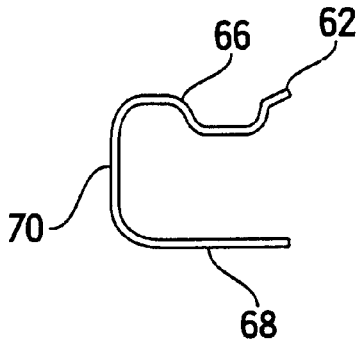
FIG. 2D is a side view of a second configuration of the valve spring and retainer of FIG. 2A in an unmounted position.
Figure 2E:
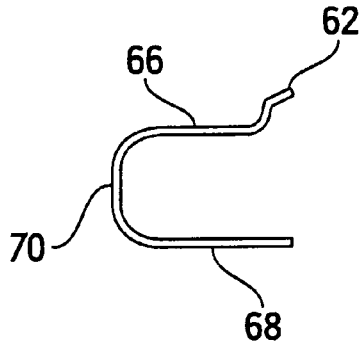
FIG. 2E is a side view of a third configuration of the valve spring and retainer of FIG. 2A in an unmounted position.
Figure 2F:
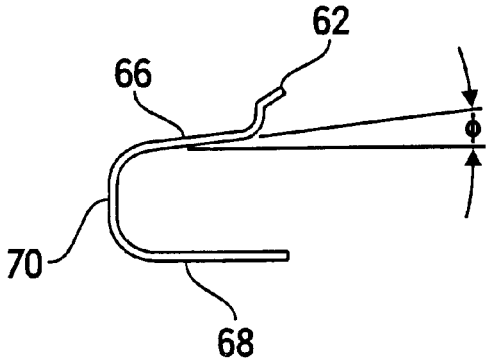
FIG. 2F is a side view of a fourth configuration of the valve spring and retainer of FIG. 2A in an unmounted position.
Figure 2G:
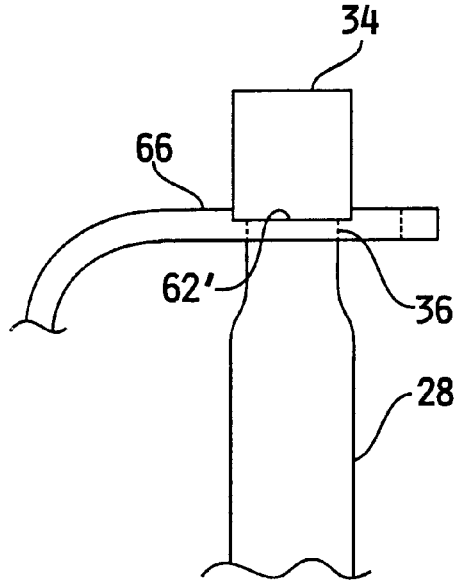
FIG. 2G is a fragmentary enlarged side view of the upper arm of the valve and spring and retainer.

When spring 40 slides into its position atop head 12, valve stem 28 is guided into lower aperture 72, located in flattened arm 68 abutting surface 78 of boss 32, and then into upper aperture 72, located in angled arm 66. Once valve stem 28 has been inserted through both apertures 72, specifically both portions 76, then spring 40 slides laterally such that smaller portion 74 of upper aperture 72 engages neck portion 36 of valve stem 28. This lateral sliding causes portion 66 of spring 40 to engage a portion of underside surface 64 of end portion 34. It should be noted that offset portion 62 is included to facilitate placement; however, bent portion 62 is not required. Bent portion 62 may also used to lock spring 40 onto valve stem 28; spring 40 may be made without bent portion 62, but such a bent portion facilitates locking spring 40. Alternatively, bent portion 62 may be replaced with coined area 62' (FIG. 2G) on upper arm 66 such that end portion 34 is locked within coined area 62'. Also, as shown in the second configuration of spring 40 is a C-shaped portion in which upper aperture 72 is located, such a portion may be used in a manner similar to coined area 62' in that end portion 34 may seated therein when spring 40 and valve stem 28 are engaged. If offset portion 62 is not included, then spring 40 may be completely reversible end-for-end since an identical aperture 72 is included in each arm 66 and 68. Since the diameter of the shank 38 of valve stem 28 is larger than the diameter of neck portion 36, portion 74 of lower aperture 72 does not engage shank 38, rather only portion 76 engages shank 38. Once spring 40 slides laterally, placing portion 74 of upper aperture 72 in engagement with valve stem 28, valve spring and retainer 40 is "locked" into position on valve stem 28, and is thereby prevented from sliding laterally to unlock it.

Figure 3:
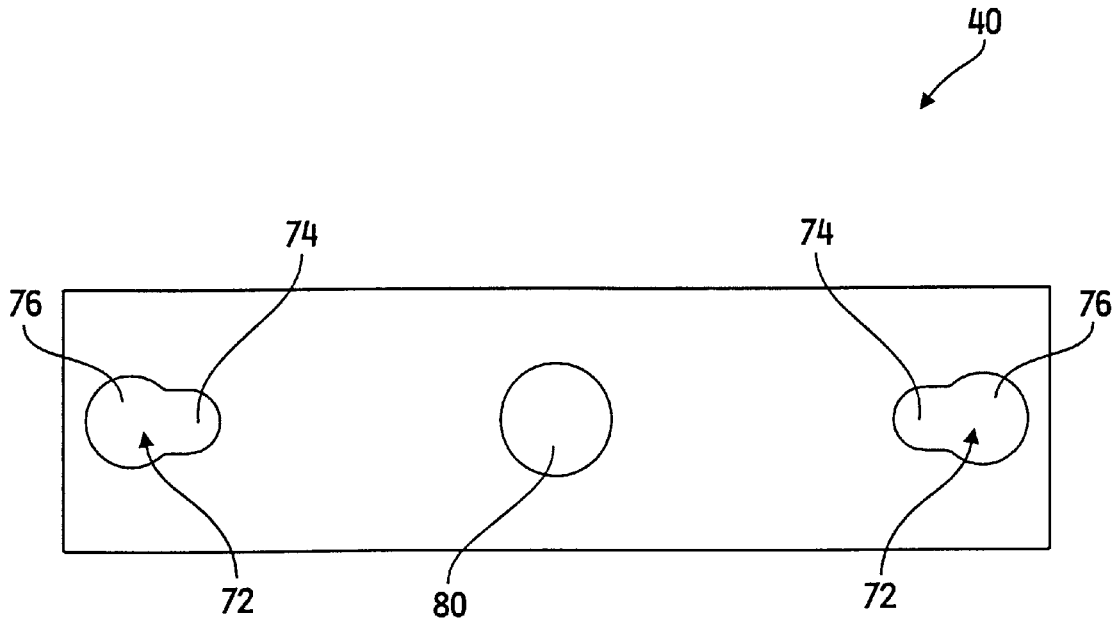
FIG. 3 is a plan view of the valve spring and retainer prior to forming.

Referring now specifically to FIG. 3, spring 40 is shown in its unbent position, or its state immediately after stamping has occurred. As such, apertures 72 are shown in an orientation such that when spring 40 is bent to its proper shape, apertures 72, specifically portions 74 and 76, are aligned in the same orientation. Additionally, optional circular aperture 80 is shown in FIG. 3 in approximately the center of the stamped piece; such an aperture facilitates stamping of the piece or insertion of a tool for easier placement in engine 10, but is not required for operation. Circular aperture 80 may be used to facilitate sliding of spring 40 onto valve stem 28 and then laterally to lock spring 40 in its proper position. Although apertures 72 are shown as being symmetrical, apertures 72 need not be symmetrical, i.e., one aperture may be structured in the keyhole shape, as shown, while the other aperture may be a circular opening, or some other structure which facilitates sliding valve stem 28 therethrough.

In operation, valve spring and retainer 40 is used to maintain valve 24, in this example, intake valve 24, in the closed position during the appropriate times in the engine cycle. The upward force of spring 40, particularly upper arm 66, against underside surface 64 of end portion 34 maintains valve 24 in the closed position.

It is to be noted that although element 40 has sometimes been referred to as valve spring 40, it is both a spring and a retainer. As such, a separate retainer is not needed to maintain the valve spring in its proper position; rather, by merely sliding the stamped valve spring and retainer 40 on to valve stem 28 and then laterally, spring and retainer 40 is located in its proper position. Further, valve spring and retainer 40 is maintained in that position through the locking engagement of aperture 72, specifically portion 74, with neck portion 36 of valve stem 28 and will not move upward and away from valve stem 28.

While this invention has been described as having an exemplary structure, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In an internal combustion engine having at least one valve including a valve stem having an end portion and a shank portion, a spring bias element urging said valve toward a closed position, said bias element comprising:

a first arm having an aperture therein, said aperture having a keyhole shape with a first portion and a second portion, said second portion being larger than said first portion, said first arm being in operative biasing engagement with said end portion of said valve stem and said aperture of said first arm engaging said valve stem with said first portion of said aperture being in locking engagement with said shank portion;

a second arm having an aperture therein through which said valve stem extends, said second arm being in sliding engagement with said shank portion of said valve stem; and a bight portion connecting said first arm and said second arm.

2. The bias element of claim 1, wherein said first arm forms an obtuse angle with said bight portion.

3. The bias element of claim 1, wherein said aperture in said second arm has a keyhole shape with a first portion and a second portion, said second portion being larger than said first portion.

4. The bias element of claim 3, wherein said bias element is reversible.

5. A method of assembling a valve spring and retainer to one of a cylinder head and block, said method comprising:

providing a one-piece spring and retainer having an upper arm and a lower arm, with each arm having an aperture therein;

aligning the spring and retainer with a valve stem;

sliding the valve stem through the apertures in both arms of the valve spring and retainer; and then sliding at least the upper arm laterally to thereby lockingly engage the valve stem.

6. In an internal combustion engine having at least one intake valve and at least one exhaust valve, each said valve including a valve stem and having an open position and a closed position, each said valve stem having an end portion and a shank portion, a pair of bias elements urging said intake valve and said exhaust valve toward said closed position, each said bias element comprising:

a pair of arms, each said arm having an aperture therein, at least one said aperture having a keyhole shape with a first portion and a second portion, said second portion being larger than said first portion and larger than an outer diameter of said valve end portion, said first aperture portion being smaller than said valve end portion outer diameter and larger than said valve shank portion, said arm having said keyhole-shaped aperture being in operative biasing engagement with said end portion of said valve stem with said first portion of said aperture being disposed around said shank portion, and the other said arm aperture receiving said shank portion of said valve stem; and a bight portion connecting said arms.

7. The bias element of claim 6, wherein said apertures in both said arms are keyhole-shaped.

8. The bias element of claim 6, wherein said shank portion includes a reduced neck portion engaged by said first portion of said aperture.

9. The bias element of claim 6, wherein said arm having said keyhole-shaped aperture forms an obtuse angle with said bight portion.

10. In combination, a valve head including at least one intake valve and at least one exhaust valve, each said valve including a valve stem and having an open position and a closed position, each said valve stem having an end portion, a shank portion, and a reduced neck portion connecting said end portion and said shank portion; and a pair of bias elements seated on said valve head and urging said intake valve and said exhaust valve toward said closed position, each said bias element comprising:

a pair of arms, each said arm having an aperture therein, at least one said aperture having a keyhole shape with a first portion and a second portion, said second portion being larger than said first portion, said arm having said keyhole-shaped aperture being in operative biasing engagement with said end portion of said valve stem and said keyhole-shaped aperture engaging said valve stem with said first portion of said aperture being in locking engagement with said neck portion, and the other said arm being in sliding engagement with said shank portion of said valve stem; and a bight portion connecting said arms.

11. The combination of claim 10, wherein said end portion includes a surface overhanging said neck portion.

12. The combination of claim 11, wherein said arm having said keyhole-shaped aperture is angled, said arm contacting at least a portion of said overhanging surface of said end portion.

13. The combination of claim 10, wherein said apertures in both said arms are keyhole-shaped.

14. The combination of claim 13, wherein said bias element is reversible.

* * * * *